US006374925B1

(12) United States Patent
Elkins et al.

(10) Patent No.: US 6,374,925 B1
(45) Date of Patent: Apr. 23, 2002

(54) WELL DRILLING METHOD AND SYSTEM

(75) Inventors: Hubert L. Elkins, Kingwood; Mark A. Merit, Spring, both of TX (US)

(73) Assignee: Varco Shaffer, Inc., Houston, TX (US)

( * ) Notice: Subject to any disclaimer, the term of this patent is extended or adjusted under 35 U.S.C. 154(b) by 3 days.

(21) Appl. No.: 09/668,440

(22) Filed: Sep. 22, 2000

(51) Int. Cl.[7] ..... E21B 7/00; E21B 44/00
(52) U.S. Cl. ..... 175/25; 175/48; 175/57
(58) Field of Search ..... 175/25, 24, 57, 175/48

(56) References Cited

U.S. PATENT DOCUMENTS 3,517,553 A * 6/1970 Williams et al. ..... 166/66
3,550,696 A * 12/1970 Kenneday ..... 175/25
3,613,806 A 10/1971 Mallot et al.
3,827,511 A * 8/1974 Jones ..... 175/25
3,889,959 A 6/1975 Persson
3,963,077 A * 6/1976 Faulkner ..... 175/25
4,570,480 A 2/1986 Fontenot et al.
4,733,233 A * 3/1988 Grosso et al. ..... 340/861
4,867,254 A 9/1989 Gavignet
5,070,949 A 12/1991 Gavignet
5,205,166 A 4/1993 McCann et al.
5,662,171 A 9/1997 Brugman et al.
5,873,420 A 2/1999 Gearhart

* cited by examiner

*Primary Examiner*—Hoang Dang
(74) *Attorney, Agent, or Firm*—Loren G. Helmreich; Browning Bushman P.C.

(57) ABSTRACT

Methods and systems are provided for drilling a well bore 60 through a subterranean formation using a drilling rig 25 and a drill string 50, whereby the bottom hole pressure while circulating drilling fluid ("ECD") may be substantially maintained when circulation is interrupted or altered, such as when adding a joint of drill pipe to or removing a joint of drill pipe from the drill string. The method includes controllably applying and maintaining a desired variable annulus fluid pressure in the well bore, and thereafter controllably releasing the pressure from the well bore 60. In addition, methods and systems are provided for rotating the drill string while trapping, maintaining and/or releasing the well bore pressure. A substantially constant ECD pressure may be maintained on a formation, thereby facilitating the use of a lower density drilling fluid than may otherwise be required to maintain well control. In one embodiment, a drill pipe connection may be made up and/or broke out while the drill string continues to rotate.

26 Claims, 1 Drawing Sheet

WELL DRILLING METHOD AND SYSTEM

FIELD OF THE INVENTION

The present invention relates to drilling subterranean well bores of the type commonly used for oil or gas wells. More particularly, this invention relates to an improved method and system for maintaining bottom hole hydrostatic pressure while making a drill pipe connection. The methods and system of this invention facilitate improving hydrostatic control of a well bore while drilling with a reduced effective circulating density ("ECD").

BACKGROUND OF THE INVENTION

Drilling subterranean wells typically requires circulating a drilling fluid ("mud") through a drilling fluid circulation system ("system"). The circulation system may include a drilling rig located substantially at the surface. The drilling fluid may be pumped by a mud pump through the interior of a drill string, through a drill bit and back to the surface of the well bore through the annulus between the well bore and the drill pipe. When the circulated drilling fluid arrives back at the surface, cuttings and other solid contaminants are commonly separated from the circulated drilling fluid such that substantially "uncontaminated" drilling fluid may be recirculated.

A primary function of drilling fluid is to provide hydrostatic well control. Traditional overbalanced drilling techniques practice maintaining a hydrostatic pressure on the formation equal to or slightly overbalanced with respect to formation pore pressure. In underbalanced drilling techniques, hydrostatic pressure is maintained at least slightly lower than formation pore pressure by the drilling fluid supplemented with surface well control equipment providing the well control.

As well depth increases, a change in density of the drilling fluid translates into a more pronounced corresponding change in hydrostatic pressure at the bottom of the well bore. Certain formations penetrated by the well bore at deeper depths may not tolerate significant changes in hydrostatic pressure. Hydrostatic pressure changes may result in either a formation fluid influx into the wellbore (a "kick") or in the drilling fluid invading or being lost into the formation ("lost circulation"). As a result, density control may become more critical as well depth increases.

Drilling fluid is circulated through the fluid system by applying a circulating pressure to the fluid at the surface to pump the fluid through the system. As drilling fluid is circulated through the system, the fluid encounters a series of friction related pressure drops, the sum of which may be roughly equal to the pump pressure required to circulate the fluid ("circulating pressure"). The circulating friction is primarily due to the dynamic interaction between the fluid and the particular conduits through which the fluid is circulating. The mud pump and bottom hole circulating pressure typically remains substantially constant for a particular set of operating parameters.

While circulating drilling fluid, such as when drilling, the bottom hole hydrostatic pressure exerted on the formation is increased above a non-circulating ("static") hydrostatic pressure by the amount of friction pressure in the well bore annulus. The resulting bottom hole pressure applied to the formation while circulating drilling fluid may be calculated in terms of an equivalent fluid density, commonly called an equivalent circulating density ("ECD").

When a drill pipe connection is required, circulation is typically terminated for a few minutes while the connection is being performed. When circulation is terminated, the bottom hole hydrostatic pressure on the formation is reduced by approximately the amount of pressure equal to the friction losses in the well bore annulus between the bit and the surface. To maintain well control while circulation is terminated, the drilling fluid density is typically sufficiently high to maintain hydrostatic control under the static conditions.

Another primary function of drilling fluid is to carry cuttings and solid materials, such as weighting agents, to the surface. To prevent cuttings and solid material entrained within the drilling fluid from falling down hole and sticking the drill pipe when circulation is terminated, one or more agents may be added to the drilling fluid to provide a "gel" strength to the fluid and/or increase fluid viscosity. The gel strength of a drilling fluid is a measure of the ability of the fluid to either suspend cuttings in the fluid or the degree to which the fluid may retard the rate at which the cuttings fall back. When movement of a drilling fluid having some degree of gel strength is stopped, the fluid may require the application of an initial pressure (stress) in excess of a minimum threshold pressure to initiate movement (shear) of the fluid. Such fluid may be referred to as a "non-Neutonian" or "Bingham plastic" fluid. The minimum stress required to initiate movement of a Bingham plastic fluid may be referred to as the Bingham yield pressure. Bingham plastic fluids may also require a higher circulation pressure and may generate higher friction pressure drops, than neutonian fluids, thereby resulting in an increased ECD for the plastic fluids.

When the drill pipe connection is completed, the mud pumps are typically reengaged to regain circulation. To initiate or "break" circulation throughout the system, a startup circulation pressure may be applied to the fluid by the mud pumps and may be transmitted through the circulation system including the bottom hole formations. In certain well bore conditions, the magnitude of the circulation startup pressure ("startup ECD") required to reach the Bingham yield pressure may exceed the circulating ECD pressure attributable in part to friction pressure as the fluid begins to circulate. Thereby, initiation of circulation of a non-neutonian fluid may have to be conducted slowly to avoid the startup ECD exceeding the ECD. Care may be required during startup and during circulation to avoid the ECD exceeding either or both the pore pressure in the formation and the fracture pressure of the formation matrix, which may result in drilling fluid circulation being partially or completely lost to the formation. Loss of circulation may result in loss of well control, loss of expensive drilling fluids, stuck drill pipe, or other related adverse consequences. Thereby, the startup ECD and the circulating ECD are both disadvantages of prior art.

As circulation is established and drill pipe rotation is commenced, the circulating pressure may reduce to the ECD pressure. The changes in circulation pressure and the corresponding changing hydrostatic pressure exerted upon the formation results in reduced control of hydrostatic pressure exerted upon the formation. In overbalanced drilling, the applied hydrostatic pressure also may be substantially higher than the minimum hydrostatic pressure that may otherwise be required to maintain well control. Those skilled in the industry may appreciate that increased drilling fluid density and hydrostatic pressure may result in reductions in rate of penetration ("ROP") by the drill bit, further resulting in increase time and well costs. The hydrostatic pressure fluctuations, the complex determinations of actual circulating bottom hole pressure, the increased fluid density, and the resultant decreased ROP are also disadvantages of the prior art.

The disadvantages of prior art are overcome by the present invention. An improved method and system for more accurately controlling well bore hydrostatic pressure and reducing the startup ECD and the ECD are described herein.

SUMMARY OF THE INVENTION

This invention provides methods and systems for drilling a well bore through a subterranean formation whereby the hydrostatic pressure exerted upon the formation by the drilling fluid ("mud") may be maintained substantially the same regardless of whether the drilling fluid is or is not being circulated. The bottom hole pressure exerted on a formation during periods of drilling fluid circulation may be the equivalent circulating density ("ECD"). The ECD may be at least partially dependent upon circulation rate and fluid density. The methods and systems of this invention may facilitate maintaining the ECD when circulation is interrupted, such as when a joint of drill pipe is added to or removed from the drill string.

An ECD may be determined at substantially any point in the well bore. The ECD may be maintained when not circulating by trapping pressure within the well bore. The magnitude of pressure trapped in the well bore may be substantially same as the friction pressure drops in the well bore annulus during circulation and/or the amount of pressure, if any, required to re-initiate circulation after circulation has ceased.

The well bore may be enclosed by one or more conventional well bore sealing members. The well bore may be at least partially enclosed by activating an annular sealing device, such as an annular rotating blowout preventer. In addition, a choke or valve member may be provided on the mud return line and a check valve may be provided in the through bore of the drill string, such that an interior of the well bore may be enclosed.

To trap pressure within the wellbore, a rotating annular BOP may be closed on the drill pipe while circulating drilling fluid through the drill string and well bore annulus and out the mud return line to a mud receptacle. In addition, the mud return line choke may be controllably closed while the circulation rate is controllably reduced, such that fluid pressure is controllably applied to and trapped within the well bore. A pressure sensing apparatus may monitor the magnitude of the pressure trapped in the annulus. A programmable controller may coordinate and control the circulation rate, the mud return line choke and the well bore fluid pressure such that as the circulation rate is reduced to substantially zero the ECD is maintained in the well bore.

A drill pipe connection may be made up or broke out, or other work may be performed during the period in which circulation is interrupted. To compensate for any pressure losses within the well bore, a booster pump, a booster line, and a booster port may be provided to pump additional fluid into the well bore annulus to maintain a desired pressure within the well bore. To re-initiate circulation, the mud return line choke may be activated to release a portion of the fluid pressure from within the well bore and the mud pumps may be activated to controllably increase the circulation rate until a desired circulation rate is established and the choke may be fully opened. In either decreasing circulation rate to shut the well in or increasing circulation rate to re-establish a desired circulation rate, the rate of change of rate of circulation may be relatively slow or small, such that dynamic force effects may be minimized.

It is an object of this invention to provide methods and systems for maintaining a reduced ECD on a formation while drilling a well bore through the formation. This invention provides methods and systems for maintaining hydrostatic control of a wellbore in either a dynamic or static fluid circulation condition. In a dynamic circulation condition, the ECD may be substantially the same as the static non-circulating well bore hydrostatic pressure, which may be less than or equal to the circulating ECD.

It is also an object of this invention to provide methods and systems for adding a joint of drill pipe to or removing a joint of drill pipe from a drill string, while substantially simultaneously maintaining well control with a hydrostatic pressure which is less than or equal to the ECD pressure.

It is a feature of this invention that pressure may be trapped and maintained within the well bore as the drilling fluid circulation rate is reduced to substantially zero. Such trapped pressure may thereby also maintain hydrostatic well control with a drilling fluid having a lower fluid density than may otherwise by required to maintain well control.

It is another feature of this invention that initiation of drilling fluid circulation may be at least partially facilitated by the release of a portion of the trapped pressure from the well bore annulus, prior to activating the mud pump. The pressure release may act upon the drilling fluid in the well bore annulus to cause a portion of the fluid to break its gel condition and begin moving, thereby reducing the amount of pressure that may be required to be applied to the drilling fluid by the mud pumped to otherwise initiate circulation. Thereby the startup ECD may be reduced.

It is also a feature of this invention that the drill string may be rotated while pressure is being trapped, being release from or maintained within the well bore. In addition, drill string rotation may be selectively interrupted or altered.

It a further feature of this invention that a joint of drill pipe may be added to or removed from the drill string while the drill string is being rotated.

Another feature of this invention is that rates of penetration by the drill bit may be realized, due to the use of the lower density drilling fluid, while maintaining well control.

It is an advantage of this invention that this invention may be practiced by utilizing commonly used and/or available components, familiar to the well bore drilling industry. A rotating annular BOP, an adjustable choke and a drill string check valve may each be included.

It is also an advantage of this invention that a drilling fluid may be used to maintain hydrostatic control of a well bore, which includes a density that may be lower than the density of a drilling fluid that may otherwise be required to maintain well control.

It is a further advantage of this invention that formation drilling fluid invasion and formation fracturing may be reduced due to the use of the lower density drilling fluid.

It is also an advantage of this invention that due to the use of a lower density fluid, drill pipe differential sticking may be minimized. In addition, a lower filter cake thickness may be deposited upon the well bore wall, which may further reduce the probability of drill string sticking.

These and further objects, features, and advantages of the present invention will become apparent from the following detailed description, wherein reference is made to figure in the accompanying drawing.

DETAILED DESCRIPTION OF PREFERRED EMBODIMENTS

Figure 1:
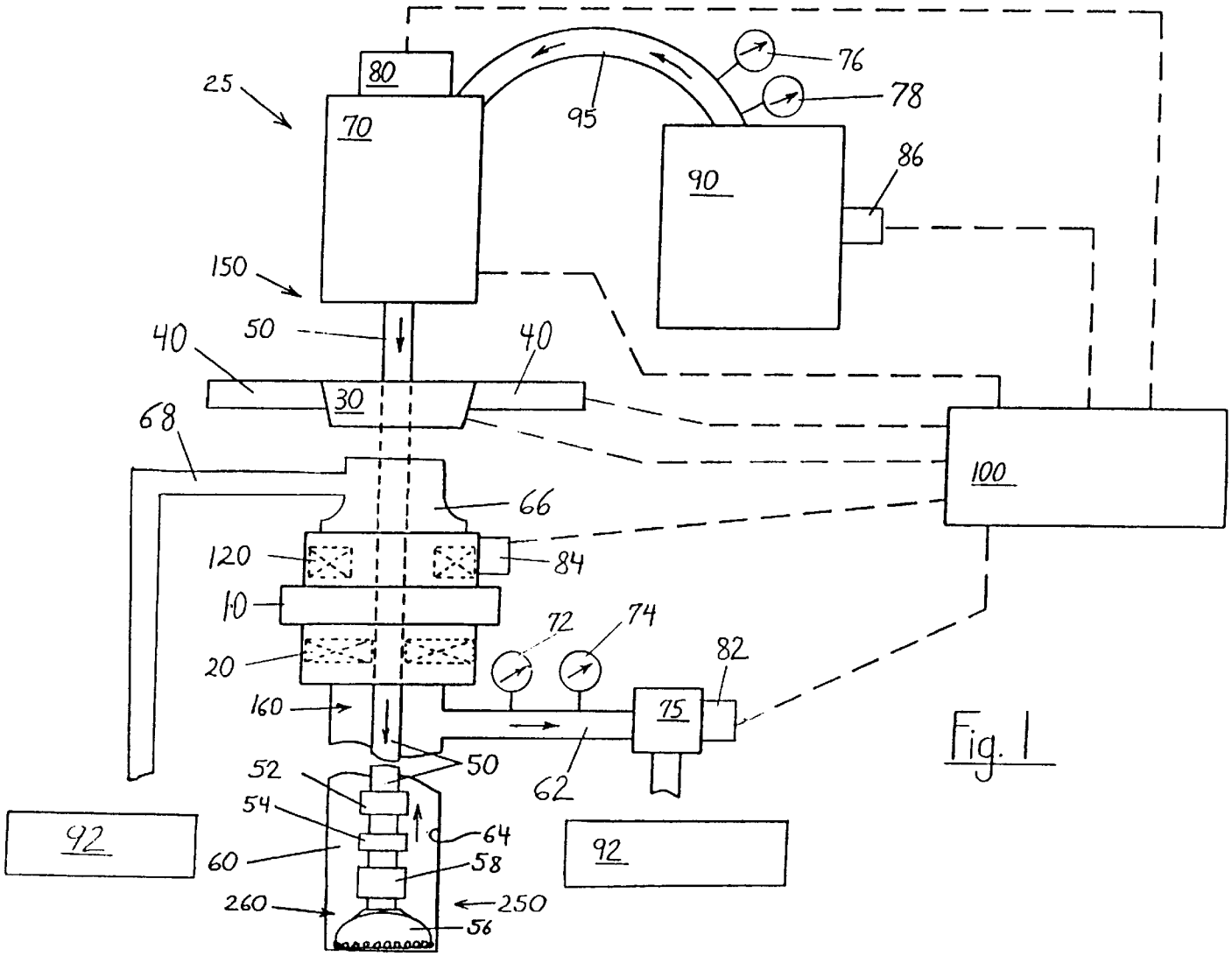
FIG. 1 is a conceptual diagram of a suitable system for drilling a well bore according to the present invention, including a system controller and optional sensors.

FIG. 1 illustrates an arrangement for components which may be included with a drilling rig 25 and which may be utilized to practice the present invention. A preferred embodiment for a system and method for drilling a well bore 60 through a subterranean formation may include a drill bit 56 supported upon a lower end of a drill string 250. The lower end of the drill string 250 may extend into a well bore 60. An upper end of the drill string 150 may be located at a drilling rig 25 at the surface. The drill string 50 may include a through bore to conduct a drilling fluid ("mud") through the drill string 50. The drill string 50 may comprise a series of interconnected joints of drill pipe.

A mud pump 90 located near the drilling rig 25 may pump a drilling fluid through a mud line 95, then into the upper end of the drill string 150, then through the drill string 50, then through the drill bit 56. The drill bit 56 may be located near a lower end of the well bore 260. The drilling fluid may then exit the drill bit 56 and circulate from the lower end of the well bore 260, then through an annulus between the drill string 50 and the well bore wall 64, and then to the upper end of the well bore 160. The drilling fluid may then exit the well bore selectively through either a mud return line 68 or a mud return flow line 62 and into a mud treating system 92. A bell nipple 66 may be provided to direct the returning drilling fluids from the annulus to the mud return line 68 and then to the mud treating system 92.

An annular blow out preventer 10 may be provided near an upper end of the well bore 160 to selectively enclose the well bore annulus. In a preferred embodiment, the annular blowout preventer 10 may be a rotating annular blowout preventer 10, such as has been disclosed in U.S. Pat. No. 5,662,171. The rotating annular blow out preventer 10 may include at least one seal member 20, 120 to seal around a portion of the drill string 50. Seal member 120 is illustrated in FIG. 1 in the opened position and seal member 20 is illustrated in the closed position. A restriction device may be provided on the return flow line 62, such as a valve or choke 75, to at least partially enclose the well bore 60.

A lower end of the drill string 250 may include a check valve 52 to prevent a back-flow of drilling fluid through the drill string 50. The lower end of the drill string 250 may also include a pressure measurement device 54, which may sense, record and/or transmit a signal representative of the hydrostatic pressure near the lower end of the drill string 250 back to the drilling rig 25. In addition, a mud motor 58 may be provided to rotate the bit 56.

A top drive 70 may be provided near an upper end 150 of the drill string 50 to rotate the drill string 50. In addition, a rotary table 40 may be provided to rotate the drill string 50. A drill string support assembly 30, such as a slip arrangement 30 may be provided to support the drill string 50. A measurement while drilling ("MWD") device 80 may be provided to provide information pertaining to one or more drilling parameters, including pressure in the well bore, such as a bottom hole pressure ("BHP"). Information indicative of BHP may be useful in deciding or determining the amount of pressure to apply or trap within the wellbore 60. A programmable system controller 100 may be included to control operation of one or more components utilized in practicing the methods and systems of this invention.

The methods of this invention may facilitate the use of a lower density drilling fluid to maintain hydrostatic well control than otherwise may be required to maintain well control. A drilling fluid may be utilized, that when circulating in the well bore 60 at a desired "baseline" circulation rate, may provide a relatively small hydrostatic overbalance or margin of excess hydrostatic pressure above formation pore pressure. The drilling fluid may include a fluid density such that the sum of the static hydrostatic pressure exerted by the drilling fluid plus the friction pressure drops of the drilling fluid circulating in the annulus may exceed the formation pore pressure. Considering the dynamics pressure force contributions exerted against the formation pore pressure, the circulating drilling fluid may provide the effect of a heavier static drilling fluid. The combined effect of the static hydrostatic pressure plus the dynamic force effects may facilitate the determination of an equivalent circulating density ("ECD") for the drilling fluid. The ECD may be maintained slightly in excess of the formation pore pressure to maintain well control while circulating. To compensate for loss of the dynamic portion of the ECD when circulation is halted or altered to a reduced rate, pressure may be selectively applied to and trapped within the well bore annulus to compensate for the lost dynamic portion of the ECD. The mud pump 90, annular BOP 10, and choke 75 may be key control components and may work in concert to create, regulate, maintain, and dissipate the trapped pressure. The selected drilling fluid circulation rate may be monitored and/or determined by pump flow rate sensor 76 and by returned drilling fluid flow rate meter 74. The selected pump pressure may be determined by pump pressure sensor 78 and the baseline drilling fluid annulus pressure may be determined by pressure sensor 72.

The returned drilling fluids circulating from the upper end of the well bore 160 may be circulated through bell nipple 66 and then through mud return line 68 and to the mud treating system 92. Choke 75 on mud return line 62 may be closed. During normal drilling and/or circulating operations, the drilling fluids may be circulated through flow line 68. Prior to trapping pressure in the well bore, choke 75 may be fully opened such that returned drilling fluid may flow through mud return line 62 and choke 75 and then to the mud treating system 92.

To trap pressure within the wellbore 60, a rotating annular BOP 10 may be closed on the drill string 50 while circulating drilling fluid through the drill string 50 and well bore annulus and out the mud return line 62 to a mud treating system 92. In addition, the mud return line choke 75 may be controllably closed while the circulation rate is reduced by controlling the mud pump 90, such that fluid pressure is controllably applied within the well bore 60. A pressure sensor 72 may monitor the magnitude of the pressure trapped in the well bore 60. The system controller 100 may at least partially, automatically coordinate and control the circulation rate by adjusting the mud return line choke position and thereby adjusting the well bore fluid pressure, such that as the circulation rate is reduced to substantially zero the ECD pressure is maintained in the well bore 60. The system controller 100 may comprise one or more various types of controllers, such as a programmable controller. In addition, the system controller 100 may include a choke regulator 82 for selectively regulating a circulation rate through the choke 75 to maintain the desired variable annulus fluid pressure within the well bore annulus 60. The system controller 100 may also include a drilling fluid pump regulator 86 for selectively regulating a circulation rate of the drilling fluid. In addition, the system controller 100 may include a rotating BOP regulator 84 for selectively regulating the operation of the BOP 10 to maintain the desired variable annulus fluid pressure within the well bore annulus 60.

The drill string check valve 52 may prevent the loss of trapped pressure from within the well bore 60, through the drill string 50. A drill pipe connection may be made up or broke out, or other work may be performed while circulation is interrupted. To compensate for any pressure losses from within the well bore when not circulating drilling fluid, a booster pump, a booster line, and a booster port may be provided to pump drilling fluid into the well bore annulus 60 to maintain the desired pressure within the well bore 60.

To re-initiate circulation, the choke 75 may be activated to release a portion of the fluid pressure from within the well bore 60 and the mud pump 90 may be substantially simultaneously activated to controllably increase the circulation rate until a desired circulation rate is established and the choke 75 may be fully opened. Choke 75 may be a "smart" choke which operates in response to an input signal, such as an electrical signal or a signal indicative of pressure signal, and/or the choke 75 may also operate independent of other components in the system. The choke may preferably operate in concert with other components in the circulation system such that each component is controlled by a common system controller 100.

In either, decreasing circulation rate when enclosing the well bore 60 or increasing circulation rate to re-establish a selected circulation rate, the rate of change in circulation rate may be relatively slow and controlled such that dynamic force effects may be minimized or at least controlled. In addition, a pressure transient response may take time to traverse through the drill string and well bore annulus. Thereby, pressure sensing equipment which is used to control components may require a small block of time to sense pressure transients in the system. To expedite system control and operation response time, such transients may be accounted for, such as by determination, calculation, measurement or otherwise, and response time in control equipment may be reduced, such that relatively little time is lost in trapping and releasing pressure within the well bore according to this invention.

The method of this invention as applied to adding a joint of drill pipe to or removing a joint of drill pipe from the drill string 50 may comprise the following six steps:

Step 1. While pumping drilling fluid at a selected drilling fluid circulation rate and at a selected drilling fluid pump pressure, open choke 75 to divert the returned drilling fluid through mud return line 62. Thereafter close the rotating annular BOP 10 at the surface while continuing to rotate the drill string 50, such as with the top drive 70 and/or rotary table 40. The annulus may include a baseline drilling fluid annulus pressure, which may be substantially zero psig. Isolate and close off any other fluid outlets in the upper end of the well bore 150.

Step 2. Controllably reduce the speed of the mud pump 90 to an altered drilling fluid circulation rate less than the selected drilling fluid circulation rate, while substantially activating the choke to trap a desired variable annulus fluid pressure within the well bore annulus. Thereby, the trapped fluid pressure in the annulus may be greater than the baseline fluid annulus pressure. The amount of trapped pressure plus the hydrostatic pressure from the drilling fluid may provide a bottom hole pressure substantially equal to the ECD when circulating drilling fluid at the selected drilling fluid circulation rate. Continue to circulate drilling fluid until the choke is closed and the desired pressure is trapped within the well bore 60. Thereby, the altered drilling fluid circulation rate may be substantially zero psig. Continue to rotate the drill string 50 until all drilling fluid circulation is stopped and then cease rotation of the drill string 50.

Step 3. Close the slips 30 on the drill string 50, and lock the rotary table if desired. Proceed with adding or removing the joint(s) of drill pipe to or from the drill string 50. Unlock the rotary table 30 if locked. In the event an unacceptably high portion of the desired variable annulus fluid pressure is lost or depleted in the formation while circulation by the mud pump 90 is stopped, a booster line and booster pump, which may be the mud pump 90 or another mud pump, may be included to maintain the annular pressure by pumping drilling fluid into the well bore 60 through a port in an upper end of the well bore 160.

Step 4. Lift the drill string to release the slips 30 and begin rotation of the drill string 50 with the rotary table 40 or top drive 70. Controllably release a portion of the trapped pressure (e.g., the desired variable annulus fluid pressure) from the well bore 60 through the choke 75, until sufficient pressure is bled off to facilitate breaking the gel strength of the drilling fluid with the mud pump 90. Releasing a portion of the pressure may assist in initiating circulation.

Step 5. Controllably begin drilling fluid circulation rate (e.g., the altered drilling fluid circulation rate) with the mud pumps while concurrently continuing to release the trapped pressure through the choke. Continue opening the choke to release fluid and pressure at a higher rate than the mud pumps 90 may be pumping. Increase the circulation rate until the altered drilling fluid circulation rate is substantially the selected drilling fluid circulation rate.

Step 6. When the selected drilling fluid circulation rate and the selected drilling fluid pump pressure are reached, and the desired variable annulus fluid pressure becomes substantially the same as the baseline drilling fluid pressure, open the rotating annular BOP 10 to minimize wear to the BOP 10. After the rotating annular BOP is fully opened, choke 75 may be closed to divert drilling fluid back through the bell nipple 66 and mud return line 68.

A programmable controller and sensing equipment, including MWD equipment, may be utilized to control and/or perform at least a portion of and preferably a substantial portion of the above procedure. For example, the programmable controller 100 may control opening and closing the rotating annular BOP, and substantially simultaneously control opening and closing the choke 75 and slowing and increasing the mud pump drilling fluid circulation rate. The programmable controller may determine the rate of change in and the magnitude of the desired variable annulus fluid pressure. The programmable controller may also maintain the selected drilling fluid circulation rate and the selected drilling fluid pump pressure. The rotary table 40, the slips 30 and the top drive 70 may also be controlled by the programmable controller.

In an alternative embodiment of this invention, the drill string may continue to rotate while stabbing and threading a new joint of drill pipe to the drill string, with substantially only intermittent stopping of rotation while torquing the connection. Further, a joint of drill pipe may be removed from the drill string with only momentary cessation of rotation to break the connection, and thereafter continue to rotate the drill string.

In another alternative embodiment of this invention, the drill string may continue to rotate while stabbing, threading and torquing a new joint of drill pipe to the drill string. In addition, a joint of drill pipe may be removed form the drill string while the drill string continues to rotate.

Yet another alternative embodiment may provide for maintaining the rotating annular BOP in a closed position.

Such application may be desirable when drilling underbalanced, wherein the base line drilling fluid annulus pressure may be greater than substantially zero psig.

In other alternative embodiments, a mud motor 58 may be provided on the drill string with which to rotate the drill bit. Thereby, rotating the drill string may only be required to orient the drill string, to prevent drill string sticking or to facilitate making up or breaking out a drill pipe connection.

In other alternative embodiments, the rotating annular BOP may be another type of well bore pressure control assembly, such as pipe rams, or a mechanical and/or hydraulic packoff.

It may be appreciated that various changes to the details of the illustrated embodiments and systems disclosed herein, may be made without departing from the spirit of the invention. While preferred and alternative embodiments of the present invention have been described and illustrated in detail, it is apparent that still further modifications and adaptations of the preferred and alternative embodiments will occur to those skilled in the art. However, it is to be expressly understood that such modifications and adaptations are within the spirit and scope of the present invention, which is set forth in the following claims.

We claim:

1. A method of drilling a well bore through a subterranean formation using a drilling rig and a drill string having a through bore and including interconnected joints of drill pipe, the method comprising:

providing a rotating BOP to maintain a desired variable annulus fluid pressure within a well bore annulus between the drill string and the well bore;

providing a drilling fluid choke in fluid communication with the well bore annulus;

pumping a drilling fluid into an upper end of the drill string, then through the drill string, then through the well bore annulus, and then substantially back to the drilling rig, the drilling fluid being pumped at at least one of a selected drilling fluid circulation rate and a selected drilling fluid pump pressure;

activating the BOP to maintain the desired variable annulus fluid pressure within the well bore annulus greater than a baseline drilling fluid annulus pressure while pumping the drilling fluid into the upper end of the drill string;

selectively closing the choke to maintain the desired variable annulus fluid pressure within the well bore annulus;

substantially simultaneously controlling both (a) an altered drilling fluid circulation rate less than the selected drilling fluid circulation rate, and (b) the desired variable annulus fluid pressure within the well bore annulus, such that the drilling fluid choke is substantially closed and the altered drilling fluid circulation rate is reduced to substantially zero; and thereafter substantially simultaneously (a) increasing the altered drilling fluid circulation rate to the selected drilling fluid circulation rate, and (b) selectively activating the drilling fluid choke to release the desired variable annulus fluid pressure in the well bore annulus, such that the drilling fluid choke is substantially opened and pressure in the well bore annulus is substantially the baseline drilling fluid annulus pressure while pumping the drilling fluid into the upper end of the drill string.

2. The method of drilling a well bore as defined in claim 1, further comprising;

using a programmable controller to control at least one of (a) a drilling fluid pump, (b) the drilling fluid choke, and (c) the rotating BOP.

3. The method of drilling a well bore as defined in claim 1, wherein the desired variable fluid pressure in the well bore annulus at a bottom end of the drill string when the circulation rate is substantially zero is substantially the same as the sum of a hydrostatic pressure of the drilling fluid in the well bore annulus plus friction pressure losses of the drilling fluid in the well bore annulus when the drilling fluid is circulated at the selected drilling fluid circulation rate.

4. The method drilling a well bore as defined in claim 1, further comprising;

adding a joint of drill pipe to the drill string while the drilling fluid choke is substantially closed and the altered drilling fluid circulation rate is substantially zero.

5. The method of drilling a well bore as defined in claim 4, further comprising:

temporarily substantially fixing the axial position of drill string with respect to the well bore while adding a joint of drill pipe to the drill string.

6. The method drilling a well bore as defined in claim 1, further comprising;

activating the BOP to open a BOP sealing member and thereby minimize wear while the pressure in the well bore annulus is substantially the selected drilling fluid annulus pressure.

7. The method drilling a well bore as defined in claim 1, further comprising;

providing a bit at the lower end of the drill string; and rotating the drill string to rotate the bit.

8. The method drilling a well bore as defined in claim 1, further comprising;

providing each of a mud motor and a bit at the lower end of the drill string; and activating the mud motor to rotate the bit.

9. The method of drilling a well bore as defined in claim 1, further comprising;

using a programmable controller to automatically control rotation of the drill string.

10. The method of drilling a well bore as defined in claim 1, further comprising:

sensing fluid pressure in at least one of the well bore annulus substantially upstream of the drilling fluid choke and the through bore in the drill string.

11. The method of drilling a well bore as defined in claim 10, further comprising;

transmitting an indication of the sensed fluid pressure to a receiver; and in response to the indication of the sensed pressure, controlling one or more of (a) the drilling fluid pump, (b) and the drilling fluid choke, and (c) the rotating BOP.

12. The method of drilling a well bore as defined in claim 10, wherein fluid pressure is sensed while drilling.

13. The method of drilling a well bore as defined in claim 1, wherein the desired variable annulus fluid pressure is at least 25 psia greater than the baseline drilling fluid annulus pressure.

14. The method of drilling a well bore as defined in claim 1, wherein the desired variable annulus fluid pressure is at least 100 psia greater than the baseline drilling fluid annulus pressure.

15. A method of drilling a well bore through a subterranean formation using a drilling rig and a drill string having a through bore and including interconnected joints of drill pipe, the method comprising:

pumping a drilling fluid into an upper end of the drill string, then through the drill string, then through a well bore annulus between the drill string and the well bore, and then substantially back to the drilling rig, the drilling fluid being pumped at at least one of a selected drilling fluid circulation rate and a selected drilling fluid pump pressure;

maintaining a desired variable annulus fluid pressure within the well bore annulus greater than a baseline drilling fluid annulus pressure while pumping the drilling fluid into the upper end of the drill string;

selectively closing off the through bore in the drill string to maintain the desired variable annulus fluid pressure within the well bore annulus;

substantially simultaneously controlling both (a) an altered drilling fluid circulation rate less than the selected drilling fluid circulation rate, and (b) the desired variable annulus fluid pressure within the well bore annulus, such that the well bore annulus is substantially enclosed and the altered drilling fluid circulation rate is reduced to substantially zero; and thereafter substantially simultaneously controlling both (a) increasing the altered drilling fluid circulation rate to the selected drilling fluid circulation rate, and (b) releasing the desired variable annulus pressure in the well bore annulus until fluid pressure in the well bore annulus is substantially the baseline drilling fluid annulus pressure while pumping the drilling fluid into the upper end of the drill string; and rotating the drill string at a selected rotational rate while pumping the drilling fluid.

16. The method of drilling a well bore as defined in claim 15, further comprising:

while the drill string is rotating at the selected rotational rate, rotating a joint of drill pipe positioned vertically above the drill string at a rotational rate greater than the selected rotational rate of the drill string to removably interconnect the joint of drill pipe with the drill string.

17. The method of drilling a well bore as defined in claim 15, further comprising:

while the drill string is rotating at the selected rotational rate, positioning a joint of drill pipe vertically above the drill string and thereafter rotating, stabbing, and threading the joint of drill pipe in releasable interconnection with the drill string;

thereafter temporarily ceasing rotation of the drill string and the joint of drill pipe such that torque may be applied to each of the drill string and the joint of drill pipe to tighten the interconnection between the drill string and the joint of drill pipe; and thereafter rotating the drill string and the joint of drill pipe at the selected rotational rate.

18. The method of drilling a well bore as defined in claim 15, further comprising:

temporarily ceasing rotating the drill string;

positioning a joint of drill pipe vertically above the drill string;

thereafter releasably interconnecting a joint of drill pipe with the drill string; and thereafter rotating the drill string and the joint of drill pipe at the selected rotational rate.

19. The method of drilling a well bore as defined in claim 15, further comprising:

rotating a selected joint of pipe in a rotational direction opposite from the selected rotational direction of the rotating drill string to disconnect the selected joint of drill pipe from the drill string.

20. A system for drilling a well bore through a subterranean formation using a drilling rig and a drill string including interconnected joints of drill pipe and the drill string including a through bore, the system comprising:

a drill string supporter for selectively substantially fixing the axial position of drill string with respect to the well bore;

a drill string rotator for selectively rotating the drill string;

a drilling fluid pump for pumping a drilling fluid into an upper end of the drill string, then through the drill string, then through the well bore annulus, and then substantially back to the drilling rig, the drilling fluid being pumped at at least one of a selected drilling fluid circulation rate and a selected drilling fluid pump pressure;

a rotating BOP to maintain a desired variable annulus fluid pressure within a well bore annulus between the drill string and the well bore greater than a baseline drilling fluid annulus pressure while pumping the drilling fluid into the upper end of the drill string;

a drilling fluid choke in fluid communication with the well bore annulus for selectively controlling a drilling fluid circulation rate and to maintain the desired variable annulus fluid pressure within the well bore annulus;

a system controller for substantially simultaneously controlling both (a) an altered drilling fluid circulation rate less than the selected drilling fluid circulation rate, and (b) the desired variable annulus fluid pressure within the well bore annulus, such that the drilling fluid choke is substantially closed and the altered drilling fluid circulation rate is reduced to substantially zero, and for thereafter substantially simultaneously (a) increasing the altered drilling fluid circulation rate to the selected drilling fluid circulation rate, and (b) selectively activating the drilling fluid choke to release the desired variable annulus fluid pressure in the well bore annulus, such that the drilling fluid choke is substantially opened and pressure in the well bore annulus is substantially the baseline drilling fluid annulus pressure while pumping the drilling fluid into the upper end of the drill string.

21. The system of drilling a well bore as defined in claim 20, further comprising;

a programmable controller to regulate at least one of (a) the drilling fluid pump, (b) the drilling fluid choke, (c) the rotating BOP, (d) the top drive, (e) the rotary table, (f) the slips.

22. The system of drilling a well bore as defined in claim 20, further comprising:

a choke regulator for selectively regulating a circulation rate through the choke to maintain the desired variable annulus fluid pressure within the well bore annulus.

23. The system of drilling a well bore as defined in claim 20, further comprising:

a drilling fluid pump regulator for selectively regulating a circulation rate of the drilling fluid.

24. The system of drilling a well bore as defined in claim 20, further comprising:

a rotating BOP regulator for selectively regulating the operation of the BOP to maintain the desired variable annulus fluid pressure within the well bore annulus.

25. The system of drilling a well bore as defined in claim 20, further comprising:

a pressure sensor to sense pressure in the well bore annulus substantially upstream of the drilling fluid choke.

26. The system of drilling a well bore as defined in claim 20, further comprising:

a flow rate sensor to sense a rate of circulation of drilling fluid in the through bore of the drill string.

* * * * *